73-151
9/28/82 SR 4,351,186

United States Patent [19]

Moulin

[11] 4,351,186

[45] Sep. 28, 1982

[54] APPARATUS FOR CONDUIT FREE-POINT DETECTION IN BOREHOLES

[75] Inventor: Pierre A. Moulin, Chaville, France

[73] Assignee: Schlumberger Technology Corporation, Houston, Tex.

[21] Appl. No.: 258,218

[22] Filed: Apr. 27, 1981

[30] Foreign Application Priority Data

Apr. 30, 1980 [FR] France ..... 80 09751

[51] Int. Cl.[3] ..... E21B 47/00

[52] U.S. Cl. ..... 73/151

[58] Field of Search ..... 33/174 L, 178 E, 178 F; 73/151

[56] References Cited

U.S. PATENT DOCUMENTS

| | | | |
|---|---|---|---|
| 2,530,309 | 11/1950 | Martin | 73/151 |
| 2,550,964 | 5/1951 | Brookes | 73/151 |
| 3,153,339 | 10/1964 | Alexander et al. | 73/151 |
| 3,233,170 | 2/1966 | Rogers | 324/24 |
| 3,686,943 | 8/1972 | Smith | 73/151 |
| 3,942,373 | 3/1976 | Rogers | 73/151 |
| 4,105,071 | 8/1978 | Nicolas et al. | 166/250 |
| 4,207,765 | 6/1980 | Kiff | 73/151 |
| 4,265,110 | 5/1981 | Moulin | 73/151 |
| 4,289,024 | 9/1981 | Basham et al. | 73/151 |

FOREIGN PATENT DOCUMENTS

| | | | |
|---|---|---|---|
| 55-27974 | 2/1980 | Japan | 33/178 F |

*Primary Examiner*—Richard R. Stearns

[57] ABSTRACT

The apparatus includes a body member lowered within drill pipes and having an upper part (26) and a lower part (27) arranged for limited movements with respect to each other. Each part of the body member is anchored inside the drill pipes and the movements between said parts are detected when stresses are applied to the drill pipes from the surface.

A first radial-coil transformer has a primary winding (35) integral with a part of the body member and a secondary winding (36,37) integral with the other part to detect the angular movements. A second axial-coil transformer has a primary winding (40) integral with a part of the body member and a secondary winding (41,42) integral with the other part to detect the longitudinal movements. The signals delivered by the transformers are linear functions of the respective movements.

14 Claims, 4 Drawing Figures

APPARATUS FOR CONDUIT FREE-POINT DETECTION IN BOREHOLES

BACKGROUND OF THE INVENTION

This invention relates to apparatus used in boreholes, and more particularly to apparatus for detecting the free point of a conduit in a borehole.

When a conduit, such as a drill string, becomes stuck in a borehole, a conventional method for determining the depth of the free point is to apply torsions and tensions to the conduit from the surface and then determine to what depth these deformations are transmitted. To detect these deformations, an apparatus is lowered into the conduit at the end of a cable and placed at successive depths.

A conventional free-point detection apparatus, described for example in U.S. Pat. No. 3,686,943 (W. D. Smith), comprises a body member having an upper part and a lower part mounted for limited movements with respect to each other, and upper and lower anchoring elements mounted respectively on the upper and lower parts to simultaneously immobilize each part in two longitudinally spaced zones of the conduit. Electric motors driven via the cable move the anchoring elements away from and toward the body member, and a transducer mounted between the parts of the body member detects the relative movements of the body parts when the conduit is deformed elastically by stresses applied from the surface.

Most known transducers must be reset before each measurement. With those transducers which have a substantially linear response, an approximate resetting is sufficient. It is then sufficient that the transducer be brought to an initial position allowing relative rotation and elongation between the upper and lower parts of the apparatus. Such transducers offer definite advantages but also exhibit drawbacks particular to each type used.

The transducer described in the above '943 patent has the disadvantage that it does not differentiate the longitudinal movements from the rotational movements. It is in fact desirable in certain cases to be able to determine whether a torsion applied to the drill pipes from the surface has been transmitted downhole. In particular, when one wishes to unscrew the free part of the pipes, it is necessary to apply an unscrewing torque to a particular joint placed slightly under tension before exploding a charge at the level of this joint. This operation, known as backing off, is quite common. In deviated wells having a bend, the torque applied to the drill pipes from the surface is transmitted poorly downhole, and it is therefore current practice to pull and release the drill pipes at the same time that the torque is applied in order to overcome the friction along the borehole. A transducer of the type described in the '943 patent does not make it possible to determine whether the torque has been transmitted down the hole, because the output signal is indistinguishably influenced by both the tensions and the torsions.

Another transducer, described in U.S. Pat. No. 4,105,071 (Y. Nicolas & A. Landaud) delivers two output signals, one independent of the tensions and the other independent of the torsions applied to the drill pipes. This transducer comprises two distinct parts, one of which is deformed by the tension forces and the other by the torsion forces. Such a transducer has a significant stiffness, and high forces are therefore necessary for deforming it. Under these conditions, it often occurs that the anchors for the apparatus are not sufficiently powerful to transmit such forces, but slip within the drill pipes without deforming the sensitive components of the transducer.

SUMMARY OF THE INVENTION

It is therefore an object of the invention to provide a transducer for detecting the free point of conduits, such as drill pipes, in a borehole, and which exhibits good characteristics of precision and reliability, making it possible to detect separately the torsions and tensions with but a small stiffness.

In a preferred embodiment of the invention, an apparatus for detecting the free point of drill pipes in a borehole comprises a body member adapted to be suspended from a cable. The body member has two parts mounted for limited longitudinal and angular movements with respect to each other. Each of the parts is capable of being anchored inside the drill pipes by a control from the surface, in order to follow the deformations of the drill pipes when tension and torsion forces are applied to them from the surface.

A first radial-coil transformer has a primary winding integral with a first part of the body member and a secondary winding integral with the second part for furnishing a first signal representative of the angular movements between the parts of the body member. The first transformer is insensitive to longitudinal movements. The secondary winding comprises two parallel-axis coils placed on opposite sides of the primary winding. The first part of the body member can turn in both directions, with a limited angular movement, from a middle position in which the axis of the primary winding is perpendicular to the axes of the coils of the secondary.

A second axial-coil transformer, having a primary winding integral with one part of the body member and a secondary winding integral with the other part, furnishes a second signal representative of the longitudinal movements between these parts of the body member. The second transformer is insensitive to angular movements of the body member parts.

The primaries of the first and second transformers are supplied with periodic current in order to induce signals in the secondaries whose amplitudes are respectively representative of the longitudinal and angular movements. Preferably, one of the parts of the body member forms a sleeve within which is provided a chamber which contains the transformers. This chamber is filled with oil and includes means, such as a floating piston, for keeping the internal pressure of the chamber equal to that of the borehole.

The apparatus also includes elastic means for opposing the weight of the lower part and for pushing it upward so that it can the move downward with respect to the upper part after anchoring in the conduit. Furthermore, means are provided for bringing the first part of the body member substantially to the middle position of the second transformer so that the first part can turn with respect to the second part in one direction or the other.

BRIEF DESCRIPTION OF THE DRAWINGS

The characteristics and advantages of the invention will moreover better appear from the description to follow given by way of nonlimitative example with reference to the appended drawings in which.

DESCRIPTION OF THE PREFERRED EMBODIMENT

Figure 1:
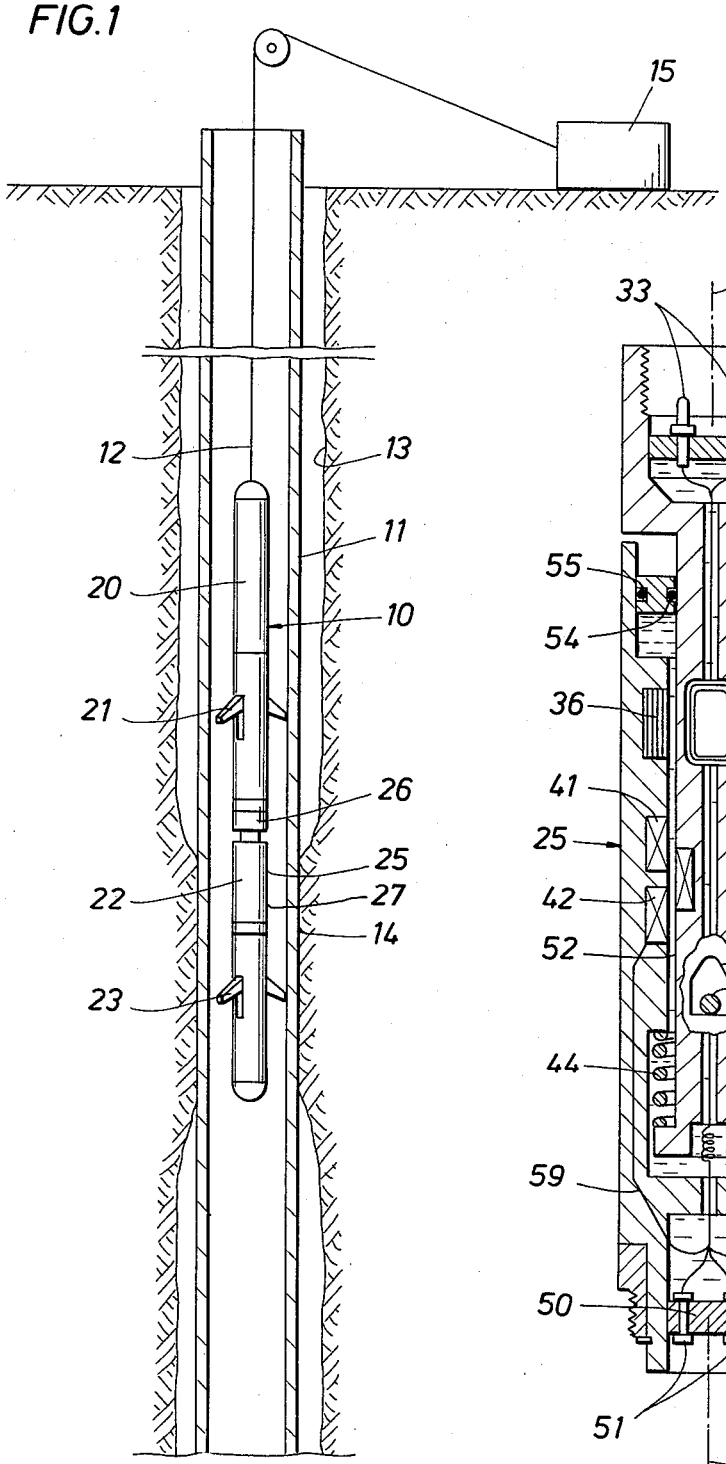
FIG. 1 is a view during operation of a detection apparatus according to the invention for finding the free point of a conduit in a borehole.

Referring to FIG. 1, the free-point detection apparatus comprises a downhole apparatus 10 suspended in a conduit 11 at the end of a cable 12. Conduit 11, which is typically a string of drill pipes, has become stuck in the earth formations in a borehole 13 at a point 14 whose depth is to be determined. The drill pipes are suspended at the surface in a known manner from a derrick (not shown) equipped with mechanisms for applying tension and torsion forces to these drill pipes.

Cable 12 has one or more electrical conductors connected to surface equipment 15. This equipment is adapted to send toward the downhole apparatus an electric power supply current and electric control signals, and to receive the signals coming from this apparatus for processing, displaying, and recording them.

The downhole apparatus 10 comprises in general an electronic section 20, an upper anchoring system 21, a transducer 22, and a lower anchoring system 23. The electronic section 20 is a sealed casing containing electronic circuits. The transducer 22 includes a body member 25 having an upper part 26 and a lower part 27 mounted movably with respect to each other, the movements being limited, however, both longitudinally and angularly. The upper and lower anchoring systems 21 and 23 are respectively fixed to the upper and lower parts 26 and 27 of the body member in order to immobilize these two parts in two longitudinally spaced zones of the drill string.

Each anchoring system can be of the type described in U.S. Pat. No. 3,686,943, mentioned above, with articulated arms adapted to move away from the body member to come up against the internal wall of the drill pipes. These arms, which can be three in number, engage and are moved by, for example, an axially moving control rod driven by an electric motor which transmits its movement to the rod via an endless screw. Each anchoring system includes a motor controlled as desired from the surface.

At the bottom of the downhole apparatus it is possible to fix a support for an explosive adapted to receive several lengths of detonating fuse to obtain an explosion at the level of a selected tool joint located over the free point. Prior to actuating the explosive, an unscrewing torque is applied from the surface to this selected joint, placing it slightly under tension so that the explosion has the effect of producing unscrewing at this level. If this operation is successful, a maximum length of free drill pipes is thus withdrawn from the borehole.

The transducer 22 delivers signals representative of the relative movements between the parts of the body member when the drill pipes are deformed elastically by tension and/or torsion stresses applied from the surface. Following these stresses, the transducer 22 indicates movement between the parts of the body member only if the downhole apparatus is anchored over the free point 14. By anchoring the apparatus 10 at various depths it is therefore possible to find that depth beneath which a signal is no longer obtained, i.e. that which corresponds to the depth at which the drill pipe is stuck.

Figure 2:
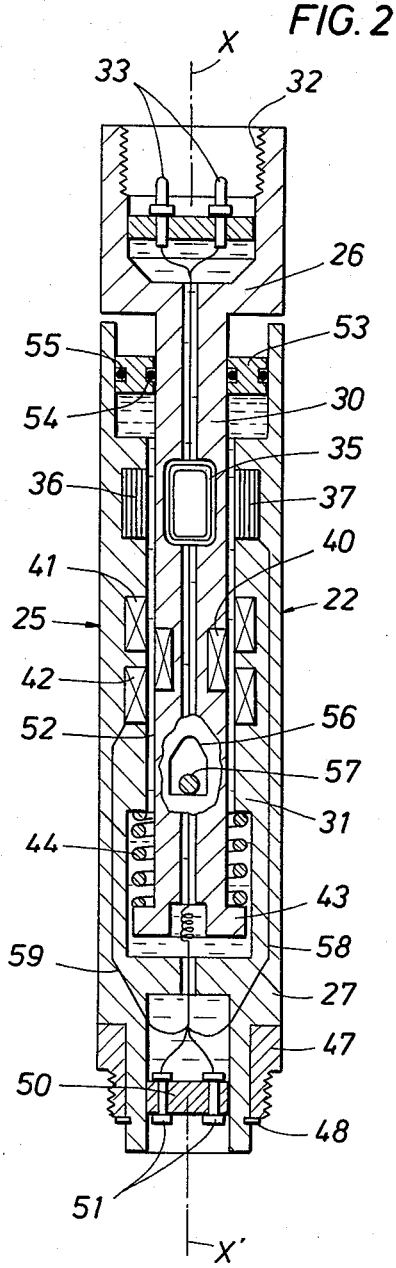
FIG. 2 is a longitudinal section of a part of the downhole apparatus of FIG. 1.

The transducer 22 is represented in greater detail in FIG. 2. The upper part 26 of the body member is extended downwardly by a mandrel 30 which can turn and move longitudinally in a sleeve 31 which extends the lower part 27 upwardly. As will be seen below, the relative movements of the two parts 26 and 27 are limited longitudinally and rotationally. The upper part 26 is tapped at 32 for attachment to the upper anchoring system 21, and connectors 33, fixed and insulated on the body member, provide suitable electrical links with the upper part of the downhole apparatus.

Figure 3:
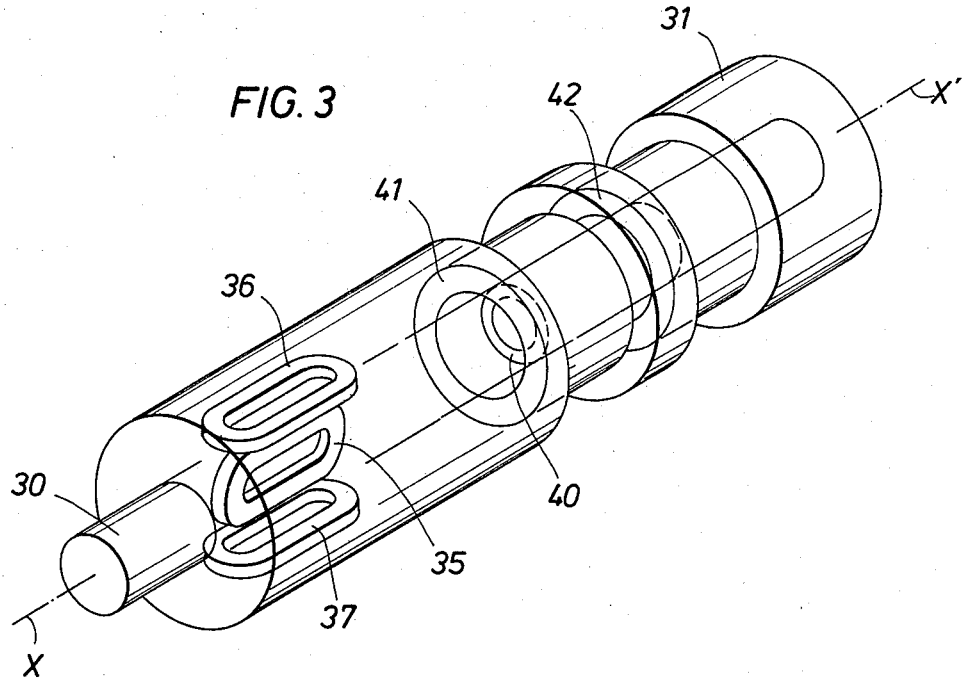
FIG. 3 is a perspective diagrammatic view of a detail of the apparatus of FIG. 2.

To detect the angular movements between the two parts 26 and 27, the transducer includes a first transformer having a primary fixed to the mandrel 30 and a secondary fixed on the sleeve 31. The primary is a coil 35 whose axis is radial, i.e. perpendicular to the longitudinal direction X–X′ of the apparatus (see also FIG. 3). The secondary is two coils 36 and 37 whose axes are also radial.

As will be seen below, the two coils of the secondary are connected in series, so that when the primary is supplied with periodic or alternating current, the signal induced in the secondary is representative of the relative angular position of the mandrel 30 and sleeve 31.

In the middle angular position, i.e. at an equal distance from the stops which limit the rotation of the mandrel 30 in the sleeve 31, the axis of the primary coil 35 is perpendicular to the common axis of the two secondary coilds 36 and 37. In this middle position, the signal induced in the secondary is nil. Note that the coils 35, 36 and 37 are sufficiently long in the X–X′ direction that the limited longitudinal movement of the mandrel 30 with respect to the sleeve 31 does not modify the output signal of the angular movement transformer.

To detect the longitudinal movements between the two parts 26 and 27, the transducer 22 includes a second transformer comprising a primary fixed to the mandrel 30 and a secondary fixed to the sleeve 31. The primary is and axial coil 40, i.e. whose axis is parallel to the X–X′ direction, and the secondary is two other axial coils 41 and 42 connected in opposition. Coil 40 is centered midway on the mandrel between the coils 41 and 42 when the sleeve 31 is in the upper position in relation to the mandrel 30, in order to deliver a substantially zero signal in this position. This second transformer, symmetrical around the X–X′ axis, is insensitive to the relative angular movements of the two parts of the body member.

The lower end of the mandrel 30 has a flange 43 on which bears a spring 44 loaded between this flange and an internal shoulder of the sleeve 31. This spring 44 is adapted to apply to the sleeve 31 an upward force slightly greater than the weight suspended from the lower part 27 of the apparatus. In this manner, when the anchoring systems 21 and 23 are anchored in the conduit, the lower part 27 of the body member is in the upper position in relation to the upper part 26. If a tension is exerted on the conduit resulting, at the depth of the apparatus, in an elongation between the anchoring zones, this elongation is then transmitted entirely to the parts 26 and 27 of the body member which, as they are in a close position, can move freely away from each other.

The lower part 27 of the body member terminates at the bottom with an end of smaller diameter on which a threaded ring 47 is rotatably mounted, and kept in place by a stop 48. This end has a recess in which is placed a support 50 for connectors 51 for effecting suitable electrical connections with the lower anchoring system 23.

The space between the mandrel 30 and the sleeve 31 forms a sealed chamber 52 closed on top by an annular piston 53 mounted slidably on the mandrel. Seals 54 and 55 provide sealing between the piston and the mandrel 30, and between the piston and the sleeve 31. The chamber 52 is filled with hydraulic fluid, and the pressure equalization piston 53 keeps the chamber at the pressure of the borehole fluids. In this way, the mandrel and the sleeve are not subjected to any longitudinal forces due to the pressure of the borehole fluids.

The different coils are connected to the electronics section of the apparatus by conductors such as 58 and 59 connected to the connectors 33.

The apparatus further comprises means for bringing the mandrel 30 substantially to the middle angular position in which the axis of the primary coil 35 is perpendicular to the common axis of the coils 36 and 37. These means include a window 56 cut in the internal face of the sleeve 31. The window 56 has two sides parallel to the longitudinal direction X–X', a flat lower face, and upper ramps converging upward to a point located in the middle of the two parallel sides. A guide key 57 integral with the mandrel 30 can move within this window. Normally, the key 57 is kept against the lower face of the window 56 by the spring 44. The longitudinal sides of the window 56 limit the angular movement of the mandrel 30 with respect to the sleeve 31. To bring the angular movement detecting transformer to the middle position, the lower anchoring system 23 is anchored and the cable is pulled to bring the guide key 57 to the top of the window 56. The mandrel, which may have turned until it is up against the sides of the window, is then brought back to the middle angular position by the key 57, which slides along one of the upper ramps of the window 56. The tension on the cable is then released and, under the action of the spring 44, the key 57 comes back to the bottom of the window 56 while remaining substantially at an equal distance from its longitudinal sides. The lower part of the body member is, at that instant, in the upper position in relation to the upper part. The angular movement transformer is in the middle position and the coil 40 of the longitudinal movement transformer is centered substantially on the middle point between the coils 41 and 42 of the secondary. The apparatus is thus ready to measure the elongations of the drill pipes and their torsions in one direction or the other.

Figure 4:
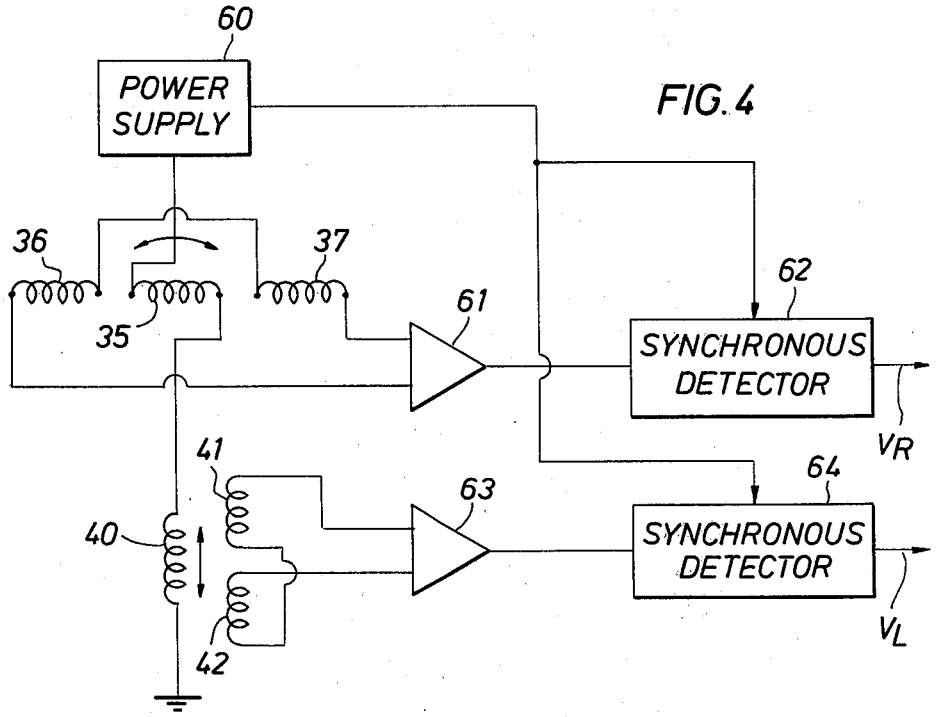
FIG. 4 is a diagram of the circuits used for obtaining detection signals in the apparatus according to the invention.

FIG. 4 shows the circuits of the apparatus which, for the most part, are located in the electronic section 20. A power supply circuit 60 delivers a triangular periodic current at the frequency of 1000 Hz to the primary coils 35 and 40, which induce rectangular voltages in the coils of the secondaries. The secondary coils 36 and 37 of the angular movement detecting transformer are connected in series to the input terminals of a differential amplifier 61. The output signal of amplifier 61 is phase rectified by a synchronous detector 62 having as reference the 1000 Hz signal of the power supply 60. The output signal of the synchronous detector 62 is a DC voltage $V_R$ which is a linear function of the angular movement of the mandrel 30 in the sleeve 31. Signal $V_R$, whose sign indicates the rotating direction, is transmitted by the cable 12 to the surface equipment 15 after having been converted, if necessary, by means of a suitable transmission system.

The secondary coils 41 and 42 of the longitudinal movement detecting transformer are connected in opposition to the terminals of a differential amplifier 63 whose output is connected to a synchronous detector 64. The reference of the detector 64 is furnished by the power supply 60. The output signal $V_L$ of the synchronous detector 64 is a DC voltage proportional to the longitudinal movement of the mandrel 30 in relation to the sleeve 31. This signal $V_L$ is transmitted to the surface via the cable 12 in the same manner as signal $V_R$.

In operation, the apparatus is assembled as shown in FIG. 1 and is lowered inside the conduit 11 to the depth at which it is wished to determine whether the drill pipes are stuck. At the chosen depth, the lower anchoring system 23 is anchored and the cable 12 is pulled to place the angular movement detecting transformer back in the middle position. The lower anchoring system is then closed and the apparatus is again anchored beginning with the upper anchoring system 21. This makes it possible to ensure that the weight of the upper part of the apparatus and of the cable does not compress the transducer 22.

Torsion and tension stresses are then applied to the conduit from the surface while displaying and recording the signals relative to the longitudinal and angular movements of the transducer. If these signals indicate that the drill pipes are free at the depth at which the apparatus is located, the above operations are begun again at other depths until one can determine the stuck point 14 at which the transducer 22 no longer indicates movements. If one wishes to unscrew the drill pipes above the stuck point, the transducer 22, and specifically the first transformer, which is sensitive to rotation only, make it possible to detect whether an unscrewing torque has been transmitted to the desired depth.

The embodiment just described can form the subject of many variants. The primary and the secondary of each transformer are interchangeable. The sleeve may be integral with the upper anchoring and the mandrel with the lower anchoring systems. The two coils in opposition can be fixed to the mandrel. The system for returning to the middle point can be implemented by other means, etc. These variants are obviously possible without departing from the framework of the invention.

What is claimed is:

1. In an apparatus for detecting the free point of a conduit in a borehole, the apparatus including a detector body adapted to be suspended from a cable and having at least two parts longitudinally and angularly movably mounted with respect to each other, and means for anchoring each of the parts inside the conduit under control from the surface, an improved detection means for respectively detecting the relative angular and longitudinal movements between the body parts when the conduit is deformed under torsion and tension stresses applied to it from the surface, said improved detection means comprising: a first transformer having a primary winding including a radial core attached to a first part of the detector body, said radial core having a radial axis perpendicular to the longitudinal axis of the detector body, and a secondary winding including two radial coils attached to the second part of the detector body and placed on opposite sides of the coil of the primary for furnishing a first electric signal representative of just the relative angular movement of said parts.

2. Apparatus according to claim 1 wherein said detection means further comprises: a second axial-coil transformer having a primary winding including an axial core attached to one part of the detector body, said axial core having an axial axis parallel to the longitudinal axis of the detector body, and a secondary winding including two longitudinally spaced axial coils partially surrounding respective portions of the primary winding and attached, with their axes parallel, to another part of the detector body for furnishing a second electric signal representative of just the relative longitudinal movement of said parts.

3. In an apparatus for detecting the free point of a conduit in a borehole, the apparatus including a detector body adapted to be suspended from a cable and having at least two parts longitudinally and angularly movably mounted with respect to each other, and means for anchoring each of the parts inside the conduit under control from the surface, an improved detection means for respectively detecting the relative angular and longitudinal movements between the body parts when the conduit is deformed under torsion and tension stresses applied to it from the surface, said improved detection means comprising:

(a) a first radial-coil transformer having a primary winding attached to a first part of the body member and a secondary winding attached to the second part of the body member for furnishing a first electric signal representative of just the relative angular movement of said parts, and (b) a second axial-coil transformer having a primary winding attached to one part of the body member and a secondary winding attached to another part of the body member for furnishing a second electric signal representative of just the relative longitudinal movement of said parts.

4. Apparatus according to claim 3 wherein the primary winding of the first transformer includes a radial coil, and the secondary winding of the first transformer includes two radial coils placed on opposite sides of the coil of the primary.

5. Apparatus according to claim 3 wherein the primary winding of the second transformer includes an axial coil, and the secondary winding of the second transformer includes two axial coils spaced longitudinally relative to each end of the primary winding.

6. Apparatus according to claim 3 wherein:

(a) the primary winding of the first transformer includes a radial coil, and the secondary winding of the first transformer includes two radial coils placed on opposite sides of the coil of the primary, and (b) the primary winding of the second transformer includes an axial coil, and the secondary winding of the second transformer includes two axial coils spaced longitudinally relative to each end of the primary winding.

7. Apparatus according to claim 1, 2, 4 or 6 wherein the coils of the secondary winding of the first transformer are mounted with their axes parallel, and further comprising means movably mounting the first part of the detector body relative to the second for limited angular movement on each side of a middle angular position at which the axis of the coil of the primary winding of said first transformer is perpendicular to the axes of the coils of the secondary winding.

8. Apparatus according to claim 7 further comprising means for bringing the first part of the detector body to an angular position corresponding substantially to said middle angular position of said first transformer.

9. Apparatus according to claim 1, 2, 3, 4, 5, or 6 further comprising means for supplying the primaries of said first and second transformers with periodic current to induce signals in the secondaries whose amplitudes are respectively representative of the angular and longitudinal movements.

10. Apparatus according to claim 1, 2, 3, 4, 5, or 6 further comprising, on one of the parts of the detector body, a sleeve having a longitudinal axis, and on the other part of the body, a mandrel mounted in said sleeve for longitudinal and rotatable movement with respect to said axis.

11. Apparatus according to claim 10 further comprising a chamber inside said sleeve, said chamber containing said transformers and being filled with a hydraulic fluid, and means for keeping said chamber at the pressure of the borehole.

12. Apparatus according to claim 1, 2, 3, 4, 5, or 6 further comprising elastic means for opposing the weight suspended from the lower part of the detector body and for pushing this lower part upward so that it can move downward with respect to the upper part of the body after anchoring in the conduit.

13. In an apparatus for detecting the free point of a conduit in a borehole, the apparatus including a detector body adapted to be suspended from a cable and having at least two parts longitudinally and angularly movably mounted with respect to each other, and means for anchoring each of the parts inside the conduit under control from the surface, an improved detection means for respectively detecting the relative angular and longitudinal movements between the body parts when the conduit is deformed under torsion and tension stresses applied to it from the surface, said improved detection means comprising:

(a) a first radial-coil transformer having a primary winding including a radial core attached to a first part of the detector body, said radial core having a radial axis perpendicular to the longitudinal axis of the detector body, and a secondary winding including two radial coils attached to the second part of the detector body and placed on opposite sides of the coil of the primary for furnishing a first electric signal representative of just the relative angular movement of said parts, (b) a second axial-coil transformer having a primary winding including an axial core attached to one part of the detector body, said axial core having an axial axis parallel to the longitudinal axis of the detector body, and a secondary winding including two longitudinally spaced axial coils partially surrounding respective portions of the primary winding and attached, with their axes parallel, to another part of the detector body for furnishing a second electric signal representative of just the relative longitudinal movement of said parts, (c) means movably mounting the first part of the detector body relative to the second for limited angular movement on each side of a middle angular position at which the axis of the coil of the primary winding of said first transformer is perpendicular to the axes of the coils of the secondary winding, (d) means for bringing the first part of the detector body to an angular position corresponding substantially to said middle angular position of said first transformer, (e) means for supplying the primaries of said first and second transformers with periodic current to induce signals in the secondaries whose amplitudes are respectively representative of the angular and longitudinal movements, (f) a sleeve having a longitudinal axis on one of the parts of the detector body, (g) a mandrel on the other part of the detector body mounted in said sleeve for longitudinal and rotatable movement with respect to said axis, (h) a chamber inside said sleeve, said chamber containing said transformers and being filled with a hydraulic fluid, (i) means for keeping said chamber at the pressure of the borehole, and (j) elastic means for opposing the weight suspended from the lower part of the detector body and for pushing this lower part upward so that it can move downward with respect to the upper part of the body after anchoring in the conduit.

14. Apparatus according to claim 13 wherein the primary windings of said transformers are mounted in said mandrel and the secondary windings of said transformers are mounted in said sleeve.

* * * * *